US007753360B2

(12) United States Patent
Takeuchi et al.

(10) Patent No.: US 7,753,360 B2
(45) Date of Patent: Jul. 13, 2010

(54) MEASURING DEVICE, SHEET-SHAPED MATERIAL TRANSPORTING DEVICE, IMAGE FORMATION DEVICE AND MEASURING METHOD

(75) Inventors: Shin Takeuchi, Ashigarakami-gun (JP); Minoru Ohshima, Ashigarakami-gun (JP); Kazuyuki Tsukamoto, Ashigarakami-gun (JP); Takao Furuya, Ebina (JP); Yoshinari Iwaki, Ebina (JP); Kaoru Yoshida, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 7 days.

(21) Appl. No.: 12/166,965

(22) Filed: Jul. 2, 2008

(65) Prior Publication Data

US 2009/0140489 A1 Jun. 4, 2009

(30) Foreign Application Priority Data

Nov. 29, 2007 (JP) ..... 2007-308353

(51) Int. Cl.
*B65H 7/08* (2006.01)

(52) U.S. Cl. ..... 271/110; 271/111

(58) Field of Classification Search ..... 271/109, 271/110, 111, 126, 152
See application file for complete search history.

(56) References Cited

U.S. PATENT DOCUMENTS

| | | | | |
|---|---|---|---|---|
| 4,919,412 | A * | 4/1990 | Weigel et al. | 271/110 |
| 5,462,267 | A * | 10/1995 | Hori | 271/10.04 |
| 6,032,946 | A * | 3/2000 | Marshall et al. | 271/152 |
| 6,270,070 | B1 | 8/2001 | Salomon et al. | |
| 6,293,539 | B1 | 9/2001 | Fukatsu et al. | |
| 6,354,585 | B1 | 3/2002 | Takahashi | |
| 6,578,841 | B2 * | 6/2003 | Salomon et al. | 271/109 |
| 7,364,150 | B2 * | 4/2008 | Nakane | 271/97 |
| 7,396,010 | B2 * | 7/2008 | Naruoka et al. | 271/149 |
| 7,413,185 | B2 * | 8/2008 | Mitsuya et al. | 271/125 |
| 7,481,421 | B2 * | 1/2009 | Tsukamoto et al. | 271/110 |
| 2004/0188916 | A1 * | 9/2004 | Tsukamoto et al. | 271/110 |
| 2005/0184447 | A1 * | 8/2005 | Tsukamoto et al. | 271/109 |
| 2007/0257418 | A1 * | 11/2007 | Tsukamoto et al. | 271/110 |
| 2008/0006985 | A1 * | 1/2008 | Kuse | 271/110 |

FOREIGN PATENT DOCUMENTS

| | | | |
|---|---|---|---|
| JP | 02127327 | A * | 5/1990 |
| JP | 05254675 | A * | 10/1993 |
| JP | A-08-002707 | | 1/1996 |
| JP | A-09-067037 | | 3/1997 |

* cited by examiner

*Primary Examiner*—Kaitlin S Joerger
(74) *Attorney, Agent, or Firm*—Oliff & Berridge, PLC

(57) ABSTRACT

A measuring device, wherein a feed-out member feeds out an uppermost one of plural sheet-shaped materials stacked on a base by rotating in contact with the uppermost sheet-shaped material, has a detector that detects a force imparted to the base and the sheet-shaped materials not in contact with the feed-out member, the force being generated by feeding-out the uppermost sheet-shaped material.

17 Claims, 6 Drawing Sheets

MEASURING DEVICE, SHEET-SHAPED MATERIAL TRANSPORTING DEVICE, IMAGE FORMATION DEVICE AND MEASURING METHOD

CROSS-REFERENCE TO RELATED APPLICATIONS

This application is based on and claims priority under 35 USC 119 from Japanese Patent Application No. 2007-308353 filed Nov. 29, 2007.

BACKGROUND

Technical Field

The present invention relates to a measuring device, a sheet-shaped material transporting device, an image formation device and a measuring method.

SUMMARY

According to an aspect of the invention, a measuring device, wherein a feed-out member feeds out an uppermost one of plural sheet-shaped materials stacked on a base by rotating in contact with the uppermost sheet-shaped material, has a detector that detects a force imparted to the base and the sheet-shaped materials not in contact with the feed-out member, the force being generated by feeding-out the uppermost sheet-shaped material.

BRIEF DESCRIPTION OF THE DRAWINGS

Exemplary embodiments of the present invention will be described in detail below with reference to the drawings, wherein.

DETAILED DESCRIPTION

Next, exemplary embodiments of the present invention will be described in detail below with reference to accompanying drawings. However, these exemplary embodiments are nothing to limit the invention.

Figure 1:
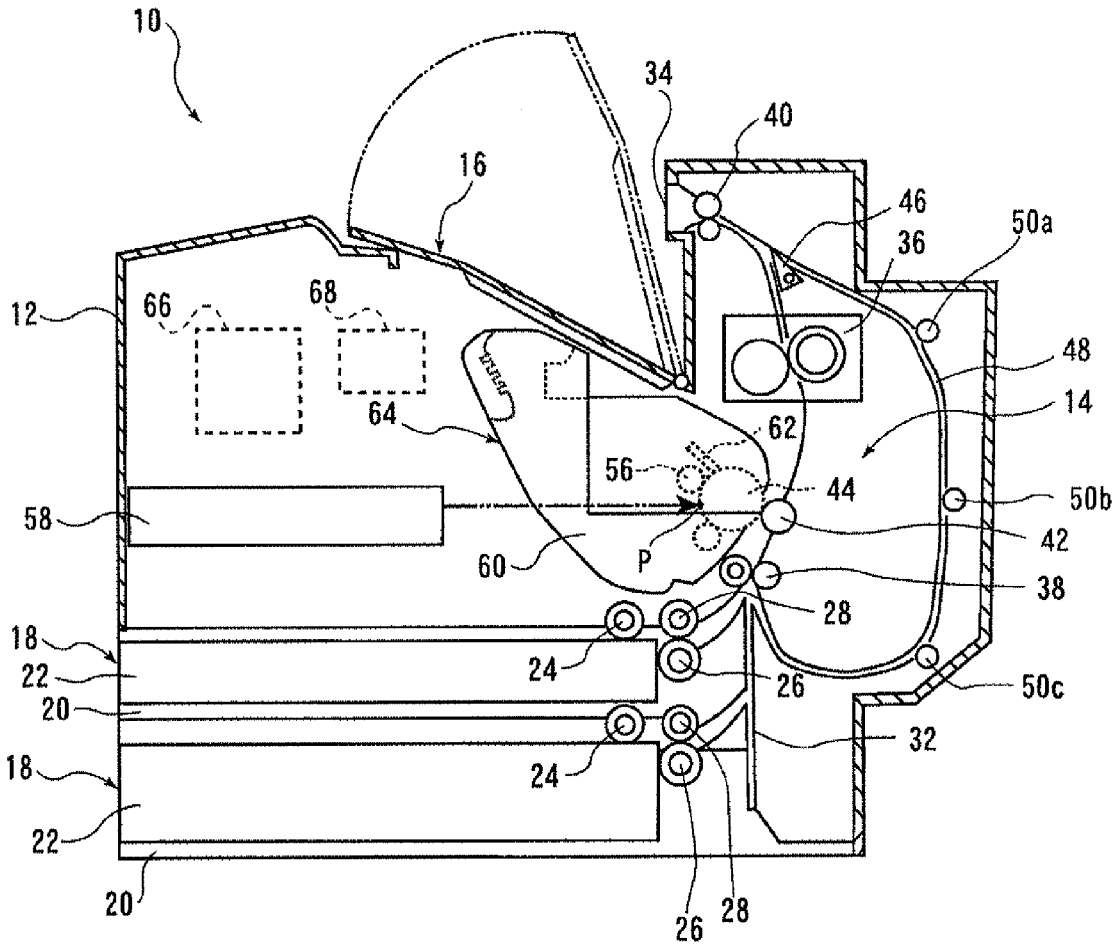
FIG. 1 is a profile outlining an image formation device which is an exemplary embodiment of the invention.

FIG. 1 outlines an image formation device 10 which is an exemplary embodiment of one aspect of the invention. The image formation device 10 has an image formation device body 12, and an image formation part 14 is mounted within this image formation device body 12. An ejecting part 16 to be described afterwards is provided above this image formation device body 12, and paper feed units 18 (recording medium transporting devices) of two levels, for instance, are arranged underneath this image formation device body 12. An arrangement is so made as to enable optional plural paper feed units to be disposed further underneath the image formation device body 12.

Each paper feed unit (recording medium transporting device) 18 has a paper feed unit body 20 and a paper feed cassette 22 which can stack plural recording media, which may be paper sheets. A feed-out member 24 is arranged above the vicinities of the farther end of the paper feed cassette 22, and a separating roller 26 and a feed roller 28 are arranged behind this feed-out member 24. The feed roller 28 is driven by a driving part (not shown), and so turns as to feed recording media toward a main transportation path 32 to be described afterwards. The separating roller 26 is pressed against the feed roller 28 to be turnable with the rotation of the feed roller 28, and so turns, together with the feed roller 28, as to feed the recording media one by one toward the main transportation path 32 to be described afterwards. For instance, when plural recording media are held between the feed roller 28 and the separating roller 26, the separating roller 26 causes the stacked recording media to slip against one another to prevent any recording medium with which the feed roller 28 is not in contact from being transported, thereby to separate the recording media and to feed out only the recording medium at the top to the main transportation path 32.

The main transportation path 32 is the passage of the recording media from the feed roller 28 to an ejection outlet 34. This main transportation path 32, located behind (in FIG. 1, on the right side of) the image formation device body 12, has apart formed substantially vertically from the paper feed unit 18 to a fixing device 36 to be described afterwards. A fixing device 42 and an image carrier 44 to be described afterwards are arranged upstream of this fixing device 36 of the main transportation path 32, and a registration roller 38 is arranged further upstream of the fixing device 42 and the image carrier 44. The registration roller 38 temporarily stops recording media fed to the main transportation path 32, and transports the recording media at a prescribed timing to the gap between the fixing device 42 and the image carrier 44.

Further, an ejection roller 40 is arranged near the ejection outlet 34 of the main transportation path 32.

Therefore, a recording medium fed out of the paper feed cassette 22 of the paper feed unit 18 to the feed-out member 24 is separated by the collaboration of the separating roller 26 and the feed roller 28, and only the recording medium at the top is guided to the main transportation path 32. The medium is temporarily stopped by the registration roller 38, a developer image is transferred onto it when it is passed at an intended timing between the fixing device 42 and the image carrier 44 as will be described afterwards and, with this transferred developer image fixed by the fixing device 36, the medium bearing it is ejected by the ejection roller 40 from the ejection outlet 34 into the ejecting part 16.

When printing is to be done on both sides of the medium, it is returned to a reverting path. Thus, the main transportation path 32 is split into two branches before the ejection roller 40, and a switching device 46 is provided at the branching point, from where a reverting path 48 to return to the registration roller 38 is formed. This reverting path 48 is provided with transporting rollers 50*a* through 50*c* and, when printing is to be done on both sides, the switching device 46 is changed over to the side of opening the reverting path 48, the turning of the ejection roller 40 is reversed at the time when a part immediately preceding the rear end of the recording medium comes into touch with the ejection roller 40 to guide the recording medium onto the reverting path 48. Then, the recording medium is ejected from the ejection outlet 34 into the ejecting part 16 past the registration roller 38, the fixing device 42, the image carrier 44 and the fixing device 36.

The image formation part 14, which may be an electrophotographic device, includes the image carrier 44 which may be a photoreceptor; an charger 56 which may be an charging roller to uniformly charge this image carrier 44; an optical writing device 58 which optically writes a latent image onto the image carrier 44 uniformly electrified by the charger 56; a developing device 60 which makes visible, with a developer, the latent image formed by this optical writing device 58 on the image carrier 44; the fixing device 42, such as a transfer roller, which transfers the developer image provided by this developing device 60 onto the recording medium; a cleaning device 62, such as a blade, for clearing the image carrier 44 of the residual developer; and the fixing device 36 which fixes the developer image on the recording medium transferred by the fixing device 42 onto the recording medium. The optical writing device 58, including a scanning type laser exposure device, is arranged in parallel to the paper feed unit 18 and on the front side of the image formation device body 12, and exposes to light the image carrier 44 across the developing device 60. Also, the optical writing device 58 exposes the image carrier 44 under the control of a controller 66 to be described afterwards. The exposure position of the image carrier 44 constitutes the latent image writing position P.

A process cartridge 64, formed by integration of the image carrier 44, the charger 56, the developing device 60 and the cleaning device 62, and all these elements can be replaced in an integrated way. This process cartridge 64 can be taken out of the image formation device body 12 by opening the ejecting part 16.

The controller 66, including a CPU and a memory (neither shown), controls the parts constituting the image formation device 10. The image formation device 10 is provided with a display 68 which displays results of processing by the controller 66 and results of detection by a pressure sensor 82 to be described afterwards.

Next, the paper feed cassette 22 and its peripheries will be described in detail.

Figure 2:
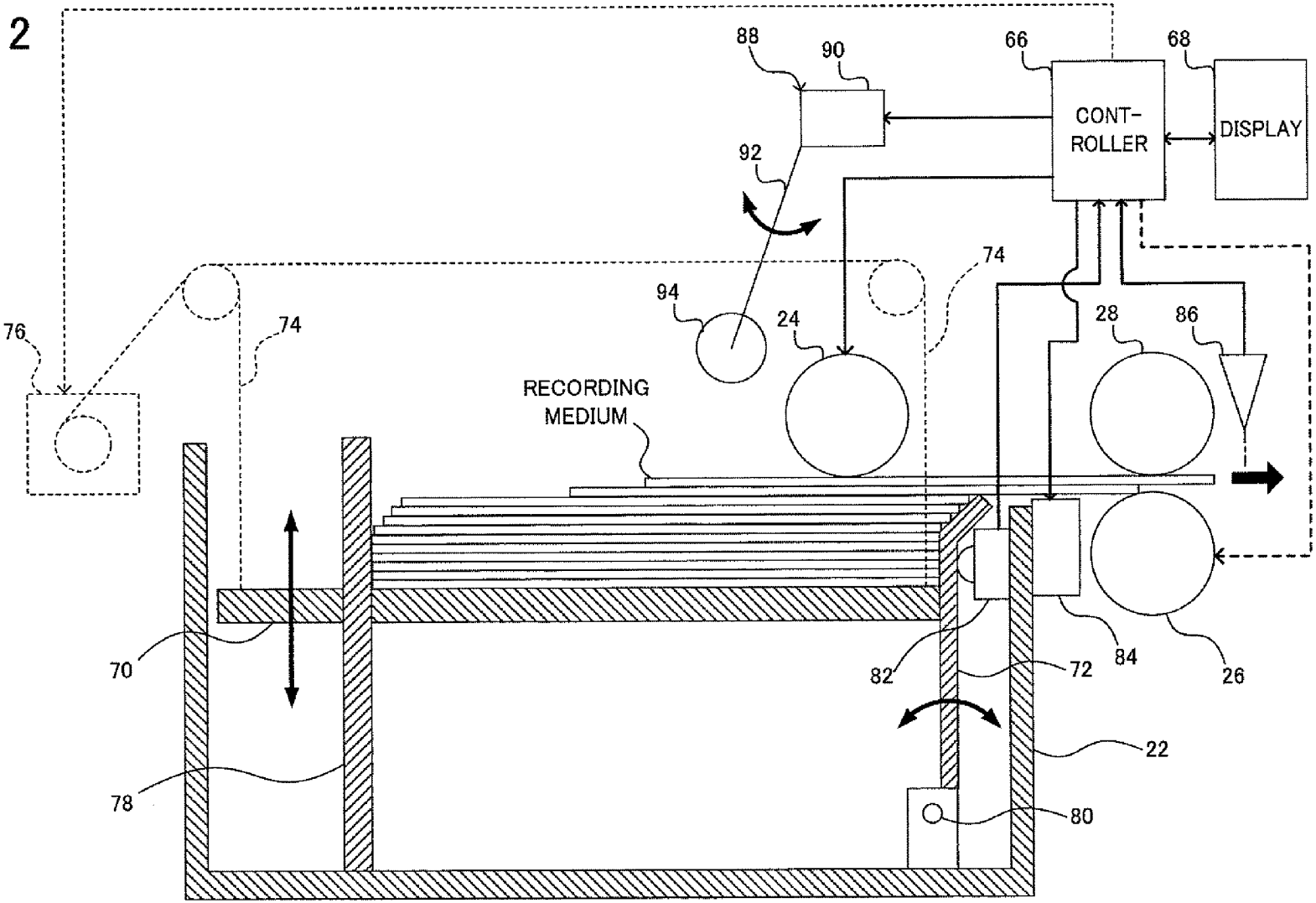
FIG. 2 is a schematic diagram showing details of the configuration of a first exemplary embodiment of a paper feed cassette and its peripheries.

FIG. 2 is a schematic diagram showing details of the configuration of a first exemplary embodiment of the paper feed cassette 22 and its peripheries. The paper feed cassette 22 has a bottom plate (base) 70 on which recording media can be stacked and a front plate 72 which supports the recording media from forward in the transporting direction (right side in FIG. 2).

The bottom plate 70 is hung on the front side and the rear side in the transporting direction by a hanging member 74 each, and moved upward or downward along a guide 78*a* by a motor 76 turning forward or backward under the control of the controller 66. The bottom plate 70 is also enabled to freely move back and forth (rightward and leftward in FIG. 2).

The front plate 72 is enabled to freely rock pivoting on a spindle 80 disposed underneath. For instance in a state of being erected vertically, the front plate 72 is held between and in contact with the bottom plate 70 and the pressure sensor 82.

The pressure sensor 82 is disposed, for instance, within the paper feed cassette 22, detects the force the recording medium and the bottom plate 70 are subjected to in the transporting direction of the recording medium (rightward in FIG. 2) as a pressure via the front plate 72, and outputs the result of detection to the controller 66.

Further, a device 84 which generates an air stream for blowing air toward the recording medium stacked on the bottom plate 70 under the control of the controller 66 is provided between the paper feed cassette 22 and the separating roller 26, and a photosensor 86 which detects the presence or absence of any recording medium and outputs the result of detection to the controller 66 is arranged downstream of the feed roller 28 in the recording medium transporting direction.

Further, a roller cleaning device 88 for cleaning the feed-out member 24 is disposed near the feed-out member 24. The roller cleaning device 88 has a cleaning device body 90, a supporting part 92 and a contact part 94. The cleaning device body 90 rocks the supporting part 92 pivoting on one end of the supporting part 92 under the control of the controller 66. The contact part 94, disposed at the other end of the supporting part 92, is enabled by the rocking of the supporting part 92 to clean the surface of the feed-out member 24 when it comes into contact with the feed-out member 24. The roller cleaning device 88 may as well be of a type that cleans the feed-out member 24 by blowing air out.

The controller 66 so controls the motor 76 as to bring the top one of the recording media stacked on the bottom plate 70 into contact with the feed-out member 24, turns the feed-out member 24 via a driving part (not shown), and transports the recording medium toward the feed roller 28 and the separating roller 26 with the frictional force of the feed-out member 24 against the recording medium.

When the feed-out member 24 has fed out the top one of the recording media stacked on the bottom plate 70, the recording media with which the feed-out member 24 is not in contact and the bottom plate 70 are subjected to a force in the recording medium transporting direction (rightward in FIG. 2). Since the front plate 72 is held between the bottom plate 70 and the pressure sensor 82, the force to which the recording media with which the feed-out member 24 is not in contact and the bottom plate 70 are subjected by the rotation of the feed-out member 24 becomes substantially equal to the resistive force against the feeding-out of the recording media by the feed-out member 24, and detected as a pressure working on the pressure sensor 82 via the front plate 72.

The controller 66 controls the load that the feed-out member 24 imposes on the recording medium according to the timing of detection by the photosensor 86 of the presence or absence of any recording medium (the moving speed of the recording medium). Further, the controller 66 controls the operation of at least one of the air stream generating device 84 and the cleaning device body 90 according to the timing of detection by the photosensor 86 of the presence or absence of any recording medium and the result of detection by the pressure sensor 82.

Incidentally, the separating roller 26 may be equipped with a control mechanism which would increase the torque in the direction reverse to the recording medium transporting direction when more than one recording medium have entered between the feed roller 28 and the separating roller 26.

Next, the processing which is performed, when the timing of the feeding out of the recording medium by the paper feed unit 18 is delayed, against the delay whose cause is identified by the controller 66.

Figure 3:
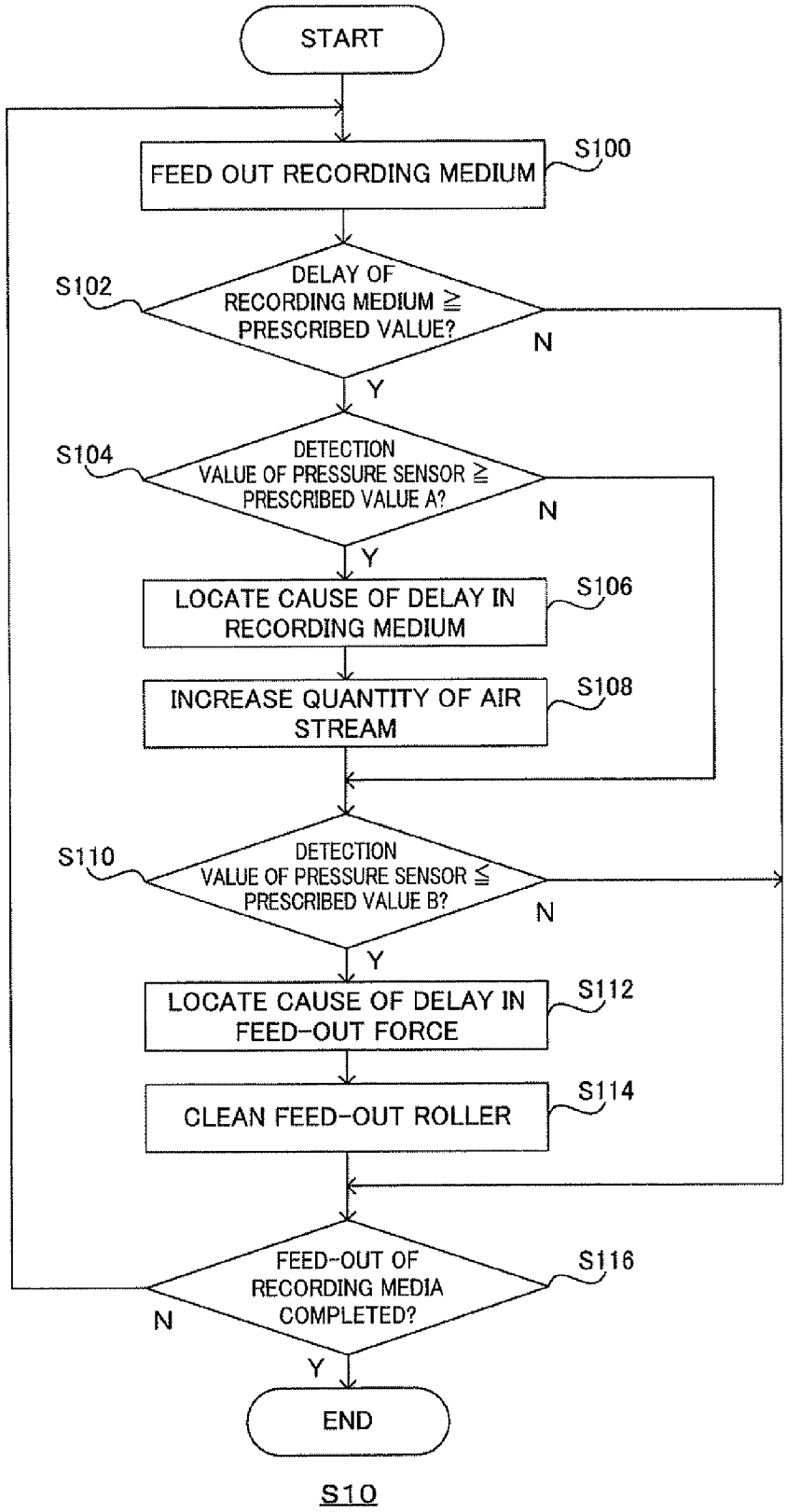
FIG. 3 is a flow chart showing an example of processing (S10) performed by the controller, when the timing of feeding out of the recording medium by the paper feed unit is delayed, against the delay whose cause is identified by the controller.

FIG. 3 is a flow chart showing an example of processing (S10) performed by the controller 66, when the timing of the feeding out of the recording medium by the paper feed unit 18 is delayed, against the delay whose cause is identified by the controller 66.

As charted in FIG. 3, at step 100 (S100), the controller 66 feeds out a recording medium stacked on the bottom plate 70 toward the gap between the feed roller 28 and the separating roller 26 by turning the feed-out member 24.

At step 102 (S802), the controller 66 determines according to the result of detection by the photosensor 86 whether the delay (in the feed-out timing) of the recording medium is not less than a prescribed value and, if the delay is not less than the prescribed value, the processing advances to S104, or if the delay is less than the prescribed value, the processing advances to S112. The delay of the recording medium occurs when the force of feed-out (carriage) by the feed-out member 24 is smaller than the resistive force against the feed-out.

At step 104 (S104), the controller 66 determines whether the value of detection by the pressure sensor 82 is not less than a prescribed value A and, if the value of detection is not less than the prescribed value A, the processing advances to S106, or if the value of detection is less than the prescribed value A, the processing advances to S108.

At step 106 (S106), the controller 66 identifies the cause of the delay (in the feed-out timing) of the recording medium in the stacked recording medium. Possible causes of the delay include one related to the force of mutual adherence between recording media and one related to the state of contact of the edge of the recording medium, such as burrs.

At step 108 (S808), the controller 66 increases the quantity of the air stream generated by the air stream generating device 84, and so separates the recording media as to improve the slip among the recording media.

At step 110 (S110), the controller 66 determines whether the value of detection by the pressure sensor 82 is not more than a prescribed value B and, if the value of detection is not more than the prescribed value B, the processing advances to S112, or if the value of detection is more than the prescribed value B, the processing advances to S116.

At step 112 (S112), the controller 66 identifies the cause of the delay (in the feed-out timing) of the recording medium to be a drop in the force of the feed-out member 24 to feed out the recording medium. Possible causes of the delay include a fall in the coefficient of the friction of the feed-out member 24 with the recording medium.

At step 114 (S114), the controller 66 cleans the surface of the feed-out member 24 via the roller cleaning device 88 and thereby improves the fall in the coefficient of the friction of the feed-out member 24.

At step 116 (S116), the controller 66 determines whether a prescribed number of recording media have been fed out and, if not, the processing advances to S100 or, if they have, the processing is ended.

Incidentally at S114, the controller 66 may, instead of cleaning the surface of the feed-out member 24, display on the display 68 that the coefficient of the friction of the feed-out member 24 with the recording medium has fallen and urge the operator to replace the feed-out member 24.

Figure 4:
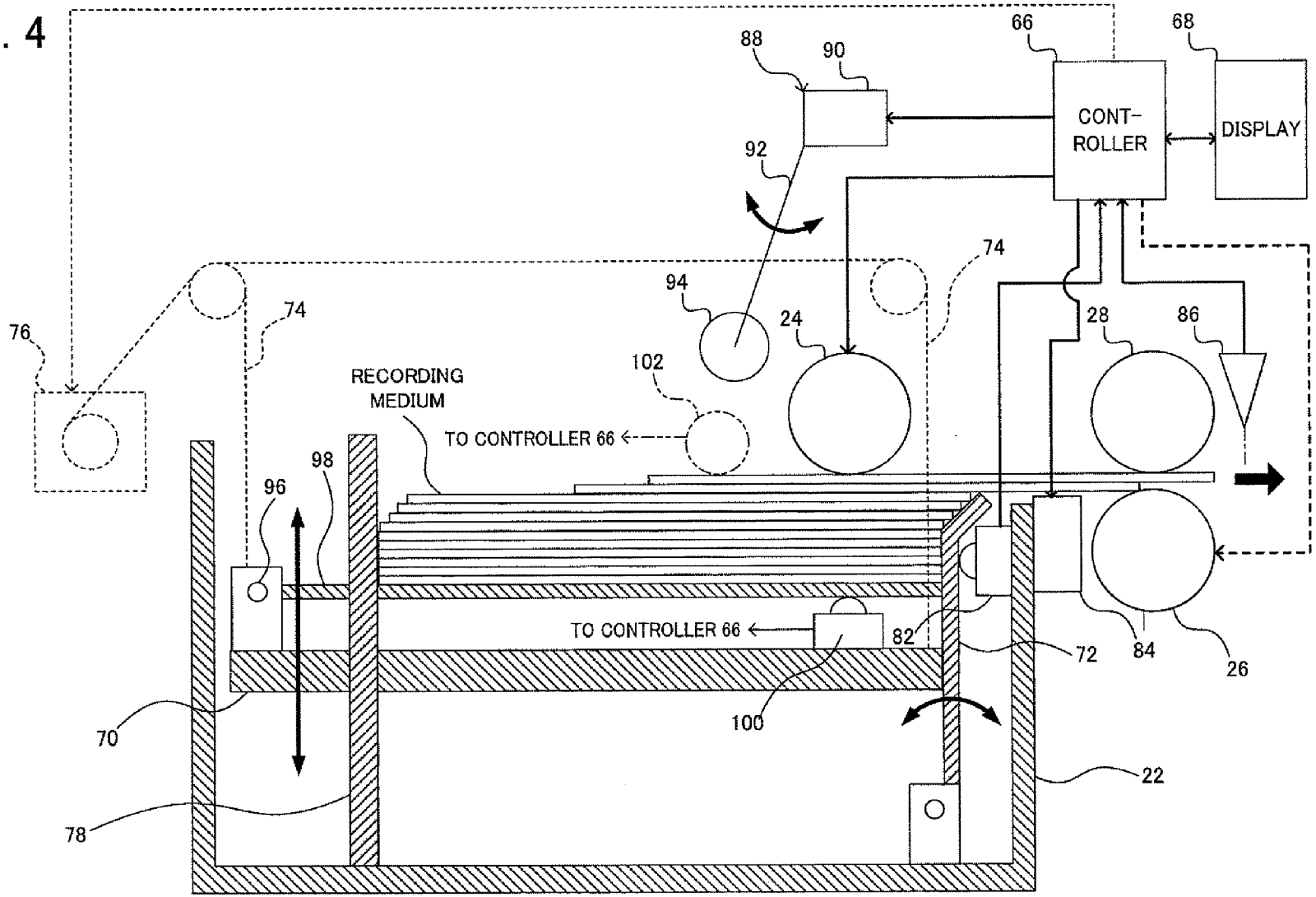
FIG. 4 is a schematic diagram showing the configuration of a second exemplary embodiment of the paper feed cassette and its peripheries.

FIG. 4 is a schematic diagram showing the configuration of a second exemplary embodiment of the paper feed cassette 22 and its peripheries.

In illustrating the second exemplary embodiment of the paper feed cassette 22, substantially the same parts constituting the first exemplary embodiment of the paper feed cassette 22 shown in FIG. 2 are assigned respectively the same reference numerals.

The bottom plate 70 is provided with a movable part 98 which freely rocks pivoting on a spindle 96 and a pressure sensor 100, and recording media can be stacked on the top face of the movable part 98. The controller 66 is so disposed as to accept the result of detection by the pressure sensor 100 and to detect the load imposed on the recording medium by the feed-out member 24. It is enabled to identify the cause of the delay (in the feed-out timing) of the recording medium according to the results of detection by the pressure sensor 82, the photosensor 86 and the pressure sensor 100, and to control the air stream generating device 84, the roller cleaning device 88 and so forth accordingly.

The paper feed cassette 22 may as well be provided with, instead of the photosensor 86, a slip sensor 102 for detecting any slip of recording media. The controller 66 may as well identify the cause of the delay (in the feed-out timing) of the recording medium according to the results of detection by the pressure sensor 82, the slip sensor 102 and the pressure sensor 100, and to control the air stream generating device 84, the roller cleaning device 88 and so forth accordingly.

Figure 5:
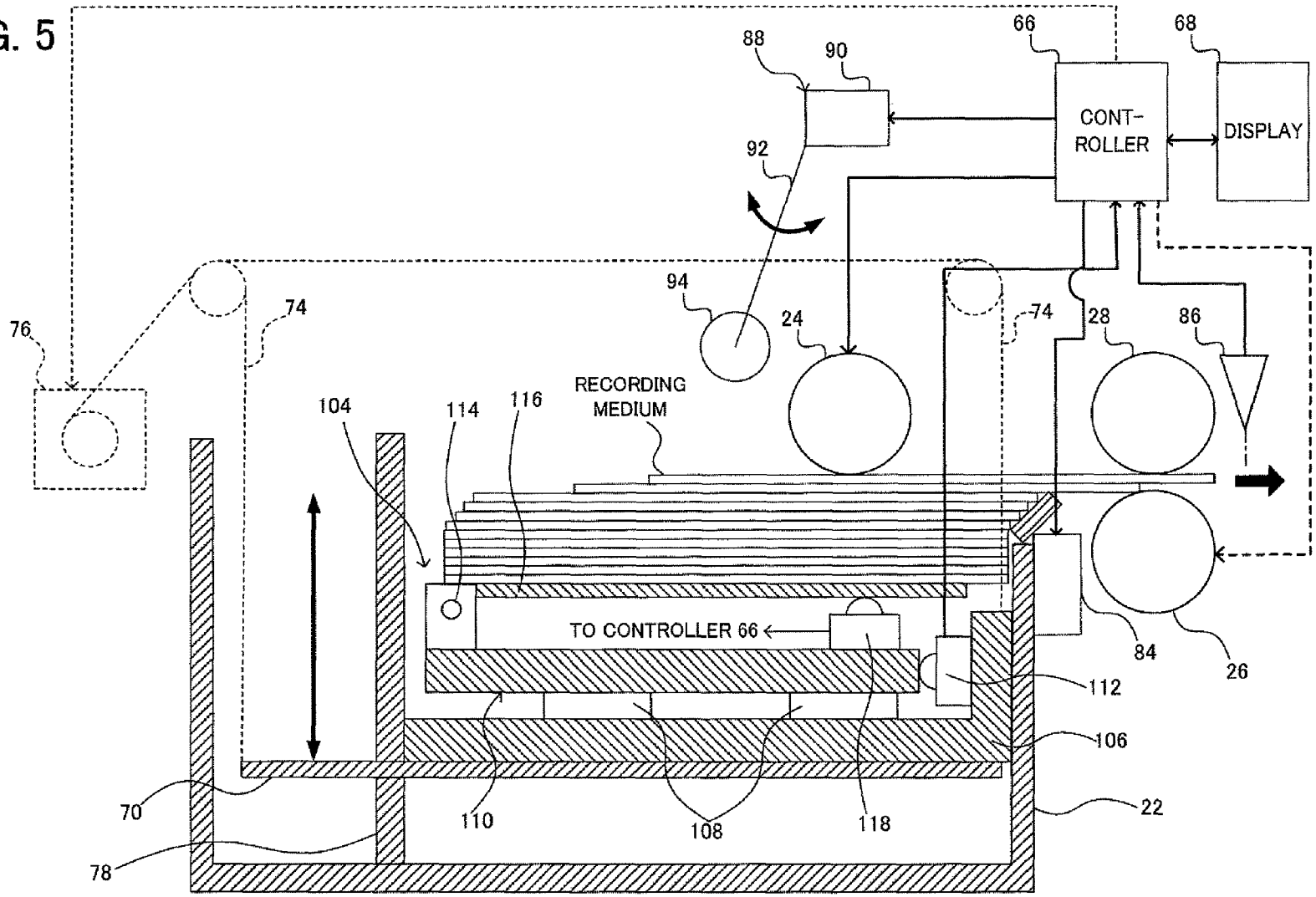
FIG. 5 is a schematic diagram showing the configuration of a third exemplary embodiment the paper feed cassette and its peripheries.

FIG. 5 is a schematic diagram showing the configuration of a third exemplary embodiment of the paper feed cassette 22 and its peripheries.

In illustrating the third exemplary embodiment of the paper feed cassette 22, substantially the same parts constituting the second exemplary embodiment of the paper feed cassette 22 shown in FIG. 4 are assigned respectively the same reference numerals.

The paper feed cassette 22 may as well be so configured as to have no front plate 72 and to instead have a loading part 104 detachably arranged over the bottom plate 70 to have recording media over the loading part 104. The loading part 104 has a base part 106, plural straight moving stages 108 arranged on this base part, a moving part 110 arranged on these straight moving stages 108, and a pressure sensor 112 which detects as a pressure the force which the moving part 110 is subjected to by the rotation of the feed-out member 24. The moving part 110 is provided with a movable part 116 which freely rocks pivoting on a spindle 114 and a pressure sensor 118, and recording media can be stacked on the top face of the movable part 116. The controller 66 is so disposed as to accept the result of detection by the pressure sensor 118 and to detect the load imposed on the recording medium by the feed-out member 24. It is enabled to identify the cause of the delay (in the feed-out timing) of the recording medium according to the results of detection by the pressure sensor 118, the photosensor 86 and the pressure sensor 112, and to control the air stream generating device 84, the roller cleaning device 88 and so forth accordingly.

Figure 6:
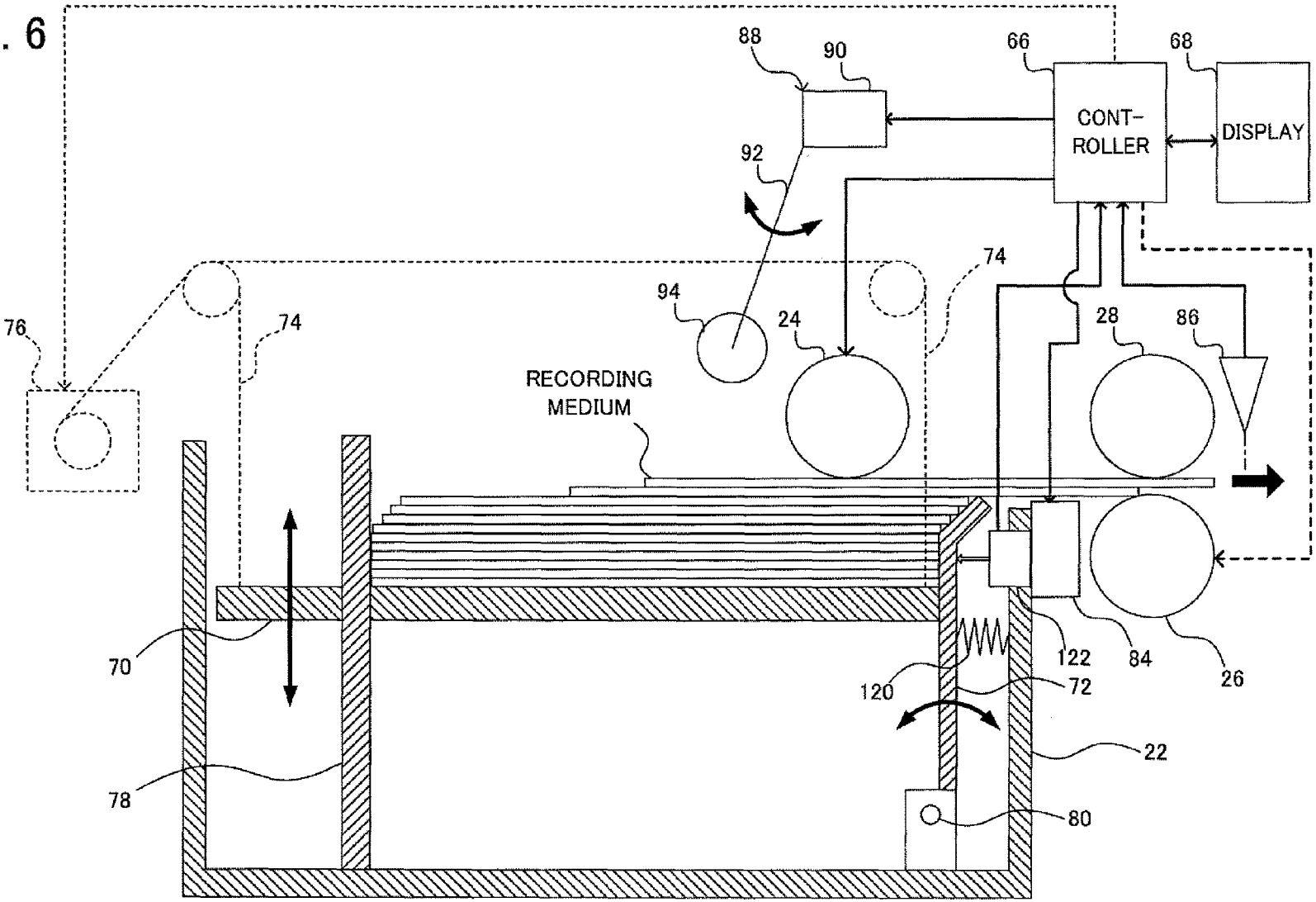
FIG. 6 is a schematic diagram showing the configuration of a fourth exemplary embodiment paper feed cassette and its peripheries.

FIG. 6 is a schematic diagram showing the configuration of a third exemplary embodiment of the paper feed cassette 22 and its peripheries.

In illustrating the fourth exemplary embodiment of the paper feed cassette 22, substantially the same parts constituting the first exemplary embodiment of the paper feed cassette 22 shown in FIG. 2 are assigned respectively the same reference numerals.

The paper feed cassette 22 may as well be so configured as to have the front plate 72 pinched between the bottom plate 70 and an elastic member 120 such as a spring and to be provided with a distance sensor 122 which detects any displacement of the bottom plate 70 by detecting the displacement of the front plate 72.

The controller 66 identifies the cause of the delay (in the feed-out timing) of the recording medium according to the results of detection by the photosensor 86 and the distance sensor 122, and to control the air stream generating device 84, the roller cleaning device 88 and so forth accordingly.

The distance sensor 122 may as well be an on/off sensor (switch) which is turned on or off according to the displacement of the front plate 72.

Although cases in which the pressure sensor 82 or the like detects the compressive form deriving from the bottom plate 70 is described in the foregoing exemplary embodiments, this is not the only applicable principle, but forces working on recording media with which the feed-out member 24 is not in contact and on the bottom plate 70 may as well be detected by detecting a tensile force deriving from the bottom plate 70.

Also, the detection of forces working on recording media with which the feed-out member 24 is not in contact and on the bottom plate 70 as well as the control of the air stream generating device 84 and the roller cleaning device 88 according to the results of detection can be applied to a paper feed cassette 22 in which the bottom plate 70 is impelled from underneath by an impelling member such as a spring.

Further, though the foregoing exemplary embodiments of the invention are described with reference to an image formation device having a measuring device and a sheet-shaped material transporting device wherein recording media, such as paper sheets on which images are recorded, are taken up as an example of sheet-shaped materials, the invention is not limited to this configuration, but the sheet-shaped materials may as well be bank notes or cards, and the measuring device and the sheet-shaped material transporting device may as well be devices intended for use with bank notes or cards.

What is claimed is:

1. A measuring device, wherein a feed-out member feeds out an uppermost one of a plurality of sheet-shaped materials stacked on a base by rotating in contact with the uppermost sheet-shaped material, comprising:

a detector that detects a force in the feed-out direction of the sheet-shaped materials imparted to the base and the sheet-shaped materials not in contact with the feed-out member, the force being generated by feeding-out the uppermost sheet-shaped material.

2. A sheet-shaped material transporting device comprising:

a base capable of bearing a plurality of sheet-shaped materials;

a feed-out member that feeds out an uppermost one of the sheet-shaped materials on the base by rotating in contact therewith; and a detector that detects a force in the feed-out direction of the sheet-shaped materials imparted to the base and the sheet-shaped materials not in contact with the feed-out member, the force being generated by feeding-out the uppermost sheet-shaped material.

3. The sheet-shaped material transporting device according to claim 2, wherein the detector detects any compressive force or tensile force from the base and the sheet-shaped materials not in contact with the feed-out member or information based on any displacement of the base.

4. The sheet-shaped material transporting device according to claim 2, further comprising:

a moving speed information detector that detects information on a moving speed of sheet-shaped materials fed out by the feed-out member; and a feed-out force controller that controls the force with which the feed-out member feeds out the sheet-shaped materials on the basis of the information detected by the moving speed information detector and the information detected by the detector.

5. The sheet-shaped material transporting device according to claim 4, further comprising:

a contact state adjuster that adjusts the state of contact between sheet-shaped materials stacked on the base on the basis of the information detected by the moving speed information detector and the information detected by the detector.

6. The sheet-shaped material transporting device according to claim 5, wherein the contact state adjuster adjusts the state of contact between sheet-shaped materials by blowing air toward the sheet-shaped materials stacked on the base.

7. The sheet-shaped material transporting device according to claim 4, further comprising:

a cleaner that cleans the feed-out member.

8. The sheet-shaped material transporting device according to claim 4, wherein the feed-out force controller controls the force with which the feed-out member feeds out the sheet-shaped materials by controlling the load that the feed-out member imposes on the sheet-shaped materials.

9. An image formation device comprising:

an image formation part that forms an image on a sheet-shaped material; and a sheet-shaped material transporting device that transports a plurality of sheet-shaped materials to the image formation part, the sheet-shaped material transporting device comprising a base capable of bearing the plurality of sheet-shaped materials, a feed-out member that feeds out an uppermost one of the sheet-shaped materials on the base by rotating in contact therewith, and a detector that detects a force in the feed-out direction of the sheet-shaped materials imparted to the base and the sheet-shaped materials not in contact with the feed-out member, the force being generated by feeding-out the uppermost sheet-shaped material.

10. The image formation device according to claim 9, further comprising a display that performs prescribed displaying according to information detected by the detector.

11. The image formation device according to claim 9, wherein the detector detects any compressive force or tensile force from the base and the sheet-shaped materials not in contact with the feed-out member or information based on any displacement of the base.

12. The image formation device according to claim 9, further comprising a moving speed information detector that detects information on a moving speed of sheet-shaped materials fed out by the feed-out member and a feed-out force controller that controls the force with which the feed-out member feeds out the sheet-shaped materials on the basis of the information detected by the moving speed information detector and the information detected by the detector.

13. The image formation device according to claim 12, further comprising a contact state adjuster that adjusts the state of contact between the sheet-shaped materials stacked on the base on the basis of the information detected by the moving speed information detector and the information detected by the detector.

14. The image formation device according to claim 13, wherein the contact state adjuster adjusts the state of contact between the sheet-shaped materials by blowing air toward the sheet-shaped materials stacked on the base.

15. The image formation device according to claim 12, further comprising a cleaner that cleans the feed-out member.

16. The image formation device according to claim 12, wherein the feed-out force controller controls the force with which the feed-out member feeds out the sheet-shaped materials by controlling the load that the feed-out member imposes on the sheet-shaped materials.

17. A measuring method for a measuring device wherein a feed-out member feeds out an uppermost one of a plurality of sheet-shaped materials stacked on a base by rotating in contact with the uppermost sheet-shaped material, the method comprising:

detecting a force in the feed-out direction of the sheet-shaped materials imparted to the sheet-shaped materials not in contact with the feed-out member, the force being generated by feeding-out the uppermost sheet-shaped material.

* * * * *